US006988340B2

(12) United States Patent
Paulshus et al.

(10) Patent No.: US 6,988,340 B2
(45) Date of Patent: Jan. 24, 2006

(54) END TERMINATION OF TENSION LEG

(75) Inventors: Bjørn Paulshus, Skedsmokorset (NO); Morten Rengman Mørck, Oslo (NO)

(73) Assignee: Kvaerner Oilfield Products AS, Lysaker (NO)

( * ) Notice: Subject to any disclaimer, the term of this patent is extended or adjusted under 35 U.S.C. 154(b) by 0 days.

(21) Appl. No.: 10/450,951

(22) PCT Filed: Dec. 20, 2001

(86) PCT No.: PCT/NO01/00503

§ 371 (c)(1),
(2), (4) Date: Sep. 11, 2003

(87) PCT Pub. No.: WO02/057560

PCT Pub. Date: Jul. 25, 2002

(65) Prior Publication Data

US 2004/0111987 A1 Jun. 17, 2004

(30) Foreign Application Priority Data

Dec. 22, 2000 (NO) ..... 20006643

(51) Int. Cl.
*E04C 5/08* (2006.01)

(52) U.S. Cl. ..... 52/223.1; 52/223.13; 52/740.1; 52/740.9; 52/223.4

(58) Field of Classification Search ..... 52/223.1, 52/223.13, 223.4, 223.9, 740.1, 740.3, 740.5, 52/740.7–740.9; 403/268, 275
See application file for complete search history.

(56) References Cited

U.S. PATENT DOCUMENTS 3,099,109 A * 7/1963 Hahn ..... 52/223.13
3,351,320 A * 11/1967 Harvey ..... 254/29 A
3,412,511 A * 11/1968 Dietrich ..... 52/223.13
3,738,071 A * 6/1973 Finsterwalder ..... 52/155
4,068,963 A * 1/1978 Brandestini ..... 403/268
4,557,007 A * 12/1985 Daiguji et al. ..... 14/22
4,633,540 A * 1/1987 Jungwirth et al. ..... 14/22
4,848,052 A * 7/1989 Nutzel ..... 52/223.13
6,381,912 B1 * 5/2002 Sorkin ..... 52/223.13
6,476,326 B1 * 11/2002 Fuzier et al. ..... 174/95
6,578,329 B1 * 6/2003 Stubler et al. ..... 52/223.14
6,610,399 B1 * 8/2003 Crigler ..... 428/375

FOREIGN PATENT DOCUMENTS

GB 2245287 A 1/1992
WO WO 98/39532 A1 9/1998

* cited by examiner

*Primary Examiner*—Jeanette E. Chapman
(74) *Attorney, Agent, or Firm*—Birch Stewart Kolasch & Birch LLP

(57) ABSTRACT

An end termination for a tension leg of non-metallic materials like composite material is disclosed. The tension leg is constructed of a number of strands which constitute the load carrying elements of the tension leg. The strands are twisted (laid) about the longitudinal axis of the tension leg by a predetermined laying length and in turn each strand is constructed of a plurality of rods of composite material having embedded strength fibres. The rods are in turn twisted about each other like in a wire rope. The strands terminate into a receiving body that forms fixing points for the respective strands. The end termination comprises an embracing element that is spaced apart from the receiving body and keeps the strands together. Intermediate the embracing element and the receiving body the strands extend less radial restriction and in a substantially natural direction towards and into apertures in the receiving body.

17 Claims, 3 Drawing Sheets

END TERMINATION OF TENSION LEG

This application is the national phase under 35 U.S.C. §371 of PCT International Application No. PCT/NO01/00503 which has an International filing date of Dec. 20, 2001, which designated the United States of America.

BACKGROUND OF THE INVENTON

1. Field of the Invention

The present invention relates to an end termination for a tension leg of non-metallic materials like composite material, which tension leg is constructed of a number of strands that constitute the load carrying elements of the tension leg, which strands are twisted (laid) about the longitudinal axis of the tension leg by a predetermined laying length and in turn each strand is constructed of a plurality of rods of composite material having embedded strength fibres, the rods are in turn twisted about each other like in a wire rope, and the strands terminate into a receiving body having connecting means and a number of through-going apertures that receive and form fixing points for the respective strands.

2. Description of Background Art

Tension legs of the above described nature are known from NO 20002812. An end termination is known from NO 20002811.

The end termination according to the invention is in particular developed in view of tension legs that anchor a tension leg platform. Other uses, however, are also of interest, i.e. vertical stays of suspension bridges and similar stays that need to be able to transfer heavy axial forces/loads.

The advantages with tension legs of composite material is low weight, great load carrying capacity in regard of weight/volume, substantially less prone to fatigue, which means that there is no need for bending restrictors, in addition to being very competitive regarding price/cost. Moreover they have the excellent quality of being able to be coiled onto reels having a diameter down to 4 meters.

Tension legs of steel find their limitation in regard of longitudinal extension, i.e. depths of the ocean, because tension legs are designed as tubulars or pipes in order to reduce the weight in water, preferably so that the tension legs become next to "weightless" when submerged in water. At greater depths it is necessary to increase the wall thickness to avoid buckling due to the external water pressure.

SUMMARY OF THE INVENTION

The now proposed solution with tension legs of composite material is also considered used when an existing tension leg platform, which is anchored by tethers of steel, is to be transferred to deeper waters. The steel tethers can then be cut off and replaced with tension legs of composite material.

Of particular concern when composite material is used to transfer forces in load carrying elements, is that the main stresses extend axially within the load carrying elements and that shear stresses should hardly appear.

According to the present invention, this is achieved by an end termination of the introductorily described type, which is distinguished in that the end termination comprises an embracing element that is spaced apart from the receiving body and keeps the strands together, and that intermediate the embracing element and the receiving body the strands extend less radial restriction and in a substantially natural direction towards and into the apertures of the receiving body.

By "natural direction," the following meant. Up to the embracing element, the tension leg extends as a compact string having twisted (laid) strands that are kept together by means of an outer sheath. From the embracing element and further up to the receiving body, the outer sheath is removed. If one temporarily disregards the receiving body, the strands will, when passing out from the embracing element, adopt a natural direction. This natural direction implies that the twisted configuration discontinues and transforms into a rectilinear configuration. The direction of each individual strand, however, will extend obliquely with respect to the longitudinal axis of the tension leg. Expressed in a different way, the strands continue toward the receiving body by a direction extending tangential to a helical line of the strands in the tension leg. And, to be noticed, in addition to this oblique direction, the strands will moreover simultaneously diverge from the longitudinal axis of the tension leg. This direction of the strands is adopted quite natural as a consequence to the restriction ceasing at a particular place.

Thus the task was to exploit this recognition to avoid the introduction of shear stresses in the strands. In order to complete the end termination the receiving body is placed over the end of the strands. The apertures in the receiving body are placed at such radial distance from the longitudinal axis of the tension leg that they correspond with the divergence of the strands at the same time as they are adapted to their oblique direction and rotational orientation.

In one embodiment of the end termination a gathering element can be arranged at a suitable place between the embracing element and the receiving body.

Examples of embedded strength fibres that can be used as rods in the strands are fibres of carbon, kevlar or aramid.

In a preferable embodiment the apertures in the receiving body can be somewhat inclined to the longitudinal axis of the tension leg and the inclination preferably correspond with the direction (natural) of the strands.

Conveniently the apertures in the receiving body may be tapered in a direction toward the embracing element.

The end termination may preferably include an external rigid sleeve that is fixed in one end thereof to the receiving body and in the other end to the embracing element.

For further connection, the receiving body can have at least one annular groove provided on the outer surface thereof for engagement with at least one first annular rib on a connecting part interconnected to an anchor point.

Further the anchor point can have at least one external annular groove for engagement with at least one second annular rib provided on the connecting part a distance apart from the at least one first rib, which connecting part is radially fixed by a surrounding connecting part.

According to the present invention, also a coupling for use between an end termination and an anchor point as described above is provided, which coupling is distinguished in that the radially outer surface of the connecting part has an upwards directed conical form and the radially inner surface of the surrounding connecting part has a complementary conical form.

Conveniently the connecting part can include pin bolts for temporary fixation of the connecting part to the anchor point.

BRIEF DESCRIPTION OF THE DRAWINGS

Other and further objects, features and advantages will appear from the following description of one for the time being preferred embodiment of the invention, which is given for the purpose of description, without thereby being limiting, and given in context with the appended drawings where.

DETAILED DESCRIPTION OF THE PREFERRED EMBODIMENTS

Figure 1:
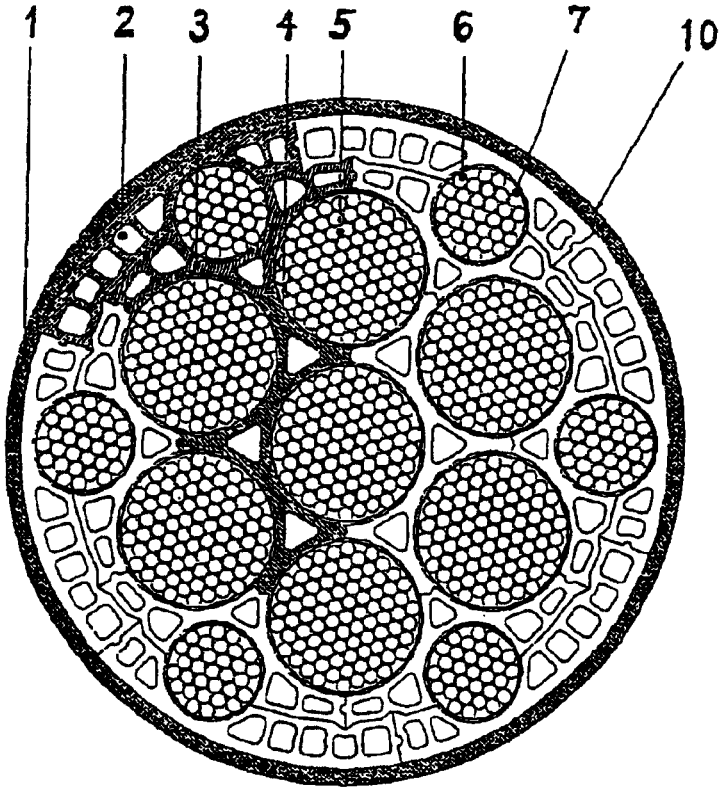
FIG. 1 shows a cross sectional view of a typical tension leg for use with the present invention.

Reference is first made to FIG. 1 that illustrates how a tension leg 10 of this nature is constructed. The tension leg 10 has an enclosing and gathering sheath 1 of a heavy duty and resistant material, such as polyethylene. Spacer elements in form of different profiles in several layers are arranged within the sheath 1, first an outer profile 2, next an intermediate profile 3 and then an inner profile 4. These profiles have no load carrying properties and only act as spacing elements. They may, as an example, be manufactured of PVC. The profiles 2, 3, 4 create between them cavities that receive respective strands 5,6, which are the load carrying elements in the tension leg 10. Each strand 5,6 is in turn constructed of a number of rods 7, which are manufactured of a composite material having embedded strength fibres. The figure shows strands 5,6 of different dimensions. Each of the seven strands 5 is made up of 85 rods 7 and each of the six strands 6 is made up of 31 rods 7.

It is the individual rods 7 within the strands 5,6 that transfer the forces/loads within the tension leg 10. The embedded strength fibres may be fibres of carbon, kevlar or aramid.

Figure 2:
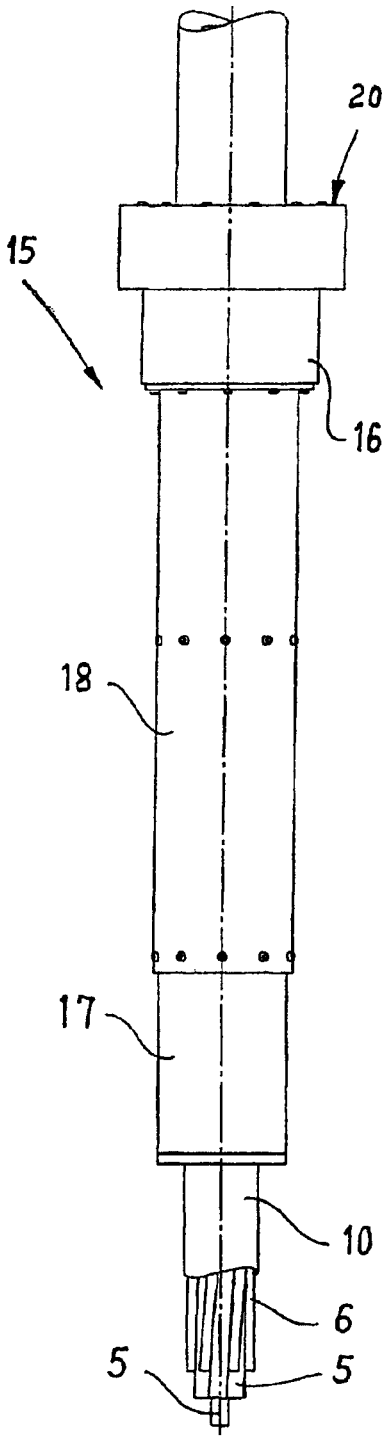
FIG. 2 shows a side elevation view of the end termination according to the invention.

FIG. 2 shows the end termination 15 of the tension leg 10. The end termination 15 is designed for connection to either an anchorage point 20 on a tension leg platform or similar on the seabed. The end termination 15 comprises a terminating receiving body 16 having external connecting means for connection to the anchorage. The receiving body 16 is in form of a heavy plate having substantial thickness. A number of apertures corresponding to the number of strands 5,6 are drilled axially through the receiving body 16. The strands 5,6 are passed into and received within the receiving body 16 and terminate here. How the strands are secured to the receiving body 16 will be more fully described with relation to FIGS. 4 and 5.

At the opposite end of the end termination 15 and spaced apart from the receiving body 16, an embracing element 17 is provided. The embracing element 17 is in form of a gathering sleeve that embraces and collects the strands 5,6 of the tension leg 10. Between the embracing element 17 and the receiving body 16, an outer sleeve 18 is arranged. The outer sleeve 18 connects the embracing element 17 and the receiving body 16 to a bending stiff and rotating stiff unit.

Figure 3:
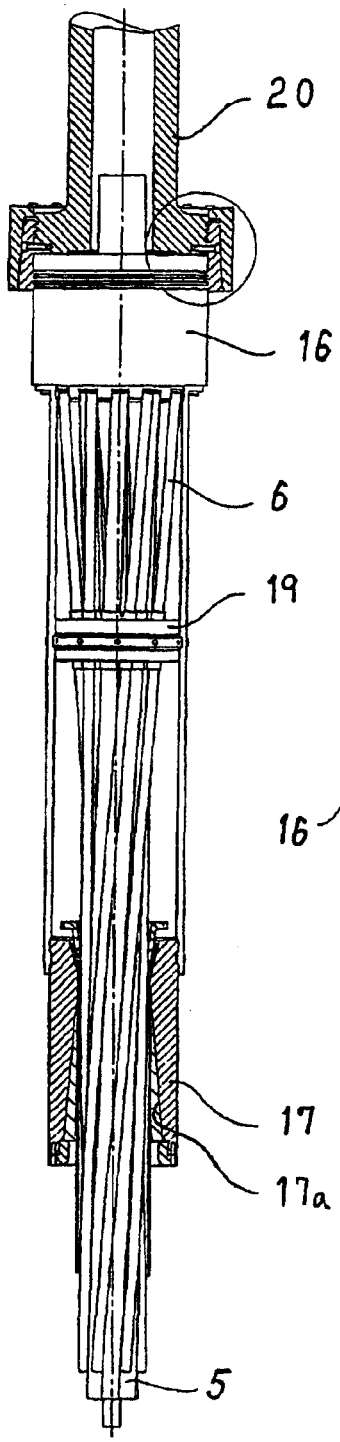
FIG. 3 shows a partial longitudinal sectional view of the end termination according to FIG. 2.

FIG. 3 illustrates how the strands 5,6 extend within the embracing element 17 and the outer sleeve 18. In the entire longitudinal extension of the tension leg 10 the strands 5,6 are twisted (laid) by a predetermined laying length about the longitudinal axis of the tension leg 10. By "laying length" is meant the number of revolutions about the longitudinal axis per length unit. For the illustrated tension leg 10 typical values will be like one revolution per 8 meters. The individual rods 7 within each strand 5,6 are in turn twisted about the longitudinal axis of the strand in the same way as in a wire rope. The laying length for the respective strands 5,6 is typically 4 meters.

The embracing element 17 has an internal surface 17*a* formed as a flared funnel facing towards the tension leg 10 proper. The internal surface 17*a* may have a radius of curvature of 10 meters as an example. It can be larger or smaller depending on the detail of construction. This curvature shall provide for that the tension leg 10 receives a controlled bending against the internal surface 17*a* of the embracing element 17 if the tension leg 10 is exposed to a lateral force. Such a lateral force will always arise because a flexible element in the tension leg connector proper is attempting to prevent lateral motion when the tension leg 10 adopts an inclined position during lateral displacement of the platform.

When the individual strands 5,6 pass out of the embracing element 17 in a direction toward the receiving body 16, the strands 5,6 will be without any radial restriction and adopt a substantially natural direction toward and into the apertures in the receiving body 16. This natural direction implies that the twisted configuration of the strands 5,6 ceases and transforms to a rectilinear configuration. However, the direction of each strand 5,6 will extend obliquely to the longitudinal axis of the tension leg 10. Said in another way, the strands 5,6 extend toward the receiving body 16 by a direction that extends tangential to the helical line of the strands 5,6 in the tension leg 10. And, to be noticed, in addition to this oblique direction, the strands 5,6 will simultaneously diverge from the longitudinal axis of the tension leg 10. This direction of the strands 5,6 is quite naturally adopted as a consequence of that the gathering and twisting cease at the exit from the embracing element 17.

Since the rods 7 normally are moulded or glued fixedly into the receiving body 16, the transition between glued and not glued area is very vulnerable to lateral forces. In order to remedy this situation, a collecting element in form of a gland 19 having a number of axially extending apertures 9 therethrough, is provided intermediate the embracing element 17 and the receiving body 16. The gland 19 is accurate positioned with respect to the receiving body 16 by means of fixation to the outer sleeve 18. Thus it is to be understood that the sleeve 18 locks the receiving body 16, the embracing element 17 and the gland 19 in mutual fixed position. This contributes to that the strands 5,6 arrive straight into the apertures 9 in the receiving body 16 and lateral forces in the vulnerable area where the glue terminates is avoided. An angular deviation of 1°, as example, where the strands 5,6 enter into the gland 19 can be anticipated. The guiding apertures 9 in the gland 19 will thus be designed as a flared funnel facing towards the embracing element 17 and has a typical radius of curvature of approx. 10 meters. This implies that a controlled bending load in the strands 5,6 is achieved.

Figure 3A:
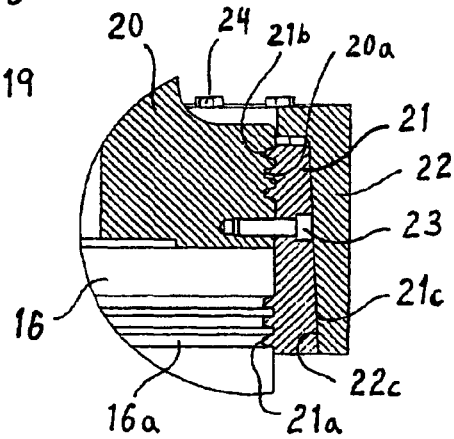
FIG. 3*a* shows the encircled part of FIG. 3, which is a cut-out of a coupling between the end termination and a connecting point.

FIG. 3*a* shows a coupling for use between the end termination 15 and a connecting point 20 (anchor point). The receiving body 16 has on the outer surface thereof connecting means, here as an example shown in form of three annular grooves 16*a* for interaction with three first annular ribs 21*a* on a connecting part 21 connected to the connecting point 20. The connecting part 21 can be made up of two, three, four or more segments that surround the receiving body 16 and the connecting point 20. Correspondingly the connecting point 20 has three external annular grooves 20*a* for interaction with three second annular ribs 21*b* provided on the connecting part 21 at a distance from the three first ribs 20*a*, the connecting part 21 being radially fixed by a surrounding, continuous connecting part 22. The radially outer surface 21*c* on the connecting part 21 has an upward directed conical form and the radially inner surface 22*c* on the surrounding connecting part 22 has a complementary conical form. The connecting part 21 may include pin bolts 23 for temporary fixation of the individual segments of the connecting part 21 to the connecting point 20.

On assembling the connector the receiving body 16 is firstly placed at the connecting point 20. Then the individual segments of the connecting part 21 are brought against the receiving body 16 and the connecting point 20 such that the ribs 21*a* and 21*b* on the connecting part 21 engage the grooves 16*a* and 20*a* on the receiving body 16 and the connecting point 20 respectively. The connecting part 21 is secured by the respective pin bolts 23 to the connecting point 20. Then the surrounding connecting part 22 is placed over the connecting part 21 so that their respective conical surfaces touch each other. Finally the surrounding connecting part 22 is axially tightened by means of a number of bolts 24 that are circumferentially positioned around the top surface of the connecting point 20. The bolts 24 extend down into threaded holes in the connecting part 21. The tightening of the bolts 24 cause wedging action between the conical surface 22*c* of the surrounding connecting part 22 and the conical surface 21*c* of the connecting part 21. Thus the connecting part 21 having the ribs 21*a* and 21*b* is urged to securely fixed engagement with the grooves 16*a* in the receiving body 16 and the grooves 20*a* in the connecting part 20 respectively and forms a fixed connection therebetween.

Figure 4:
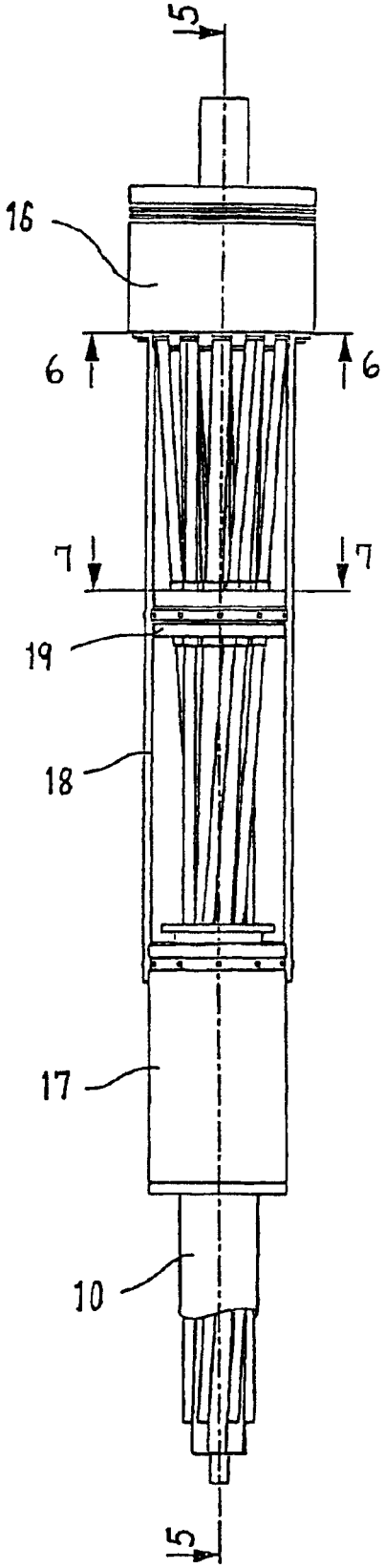
FIG. 4 shows a side elevation view like FIG. 2 where parts of an enclosure is omitted.
Figure 5:
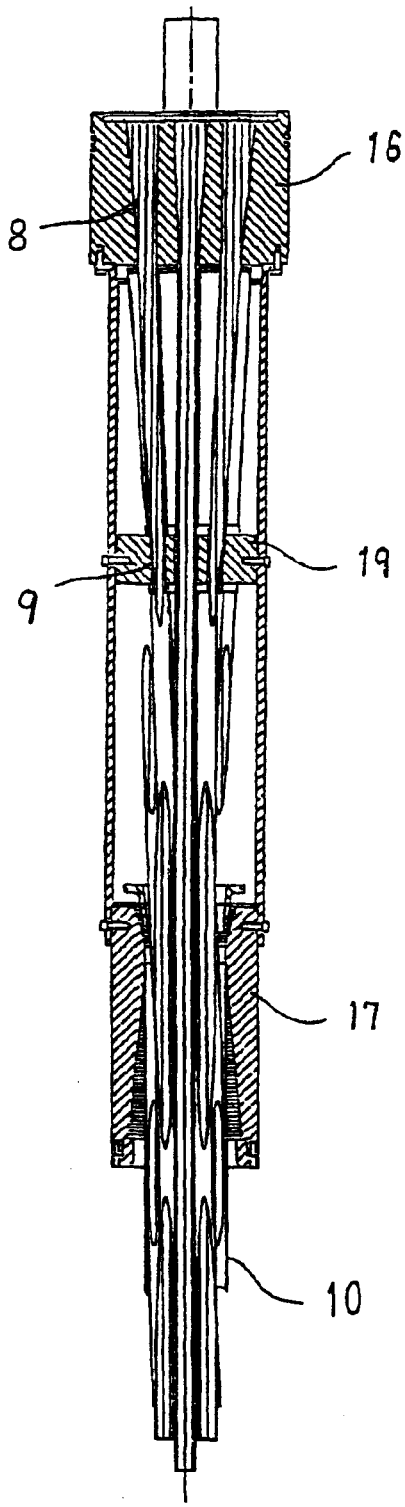
FIG. 5 shows a longitudinal sectional view along the line 5—5 in FIG. 4.

Reference is now made to FIGS. 4 and 5. The receiving body 16 has as mentioned a number of apertures 8, corresponding to the number of strands 5,6, drilled or formed substantially axially therethrough. The final fixation of the strands 5,6 to the receiving body 16 is typically made by gluing, i.e. that a liquid epoxy is poured into the apertures and around the strands 5,6 and are set to curing. The apertures are typically conical. During load the cured epoxy cone having the embedded strand ends are pulled further into the conical apertures. A high hydrostatic pressure is created which further locks the strands 5,6 against slip.

The individual rods 7 in a strand 5,6 can conveniently, when they enter into the receiving body 16, be let loose so that they spread out, though modest, in this area. Thus the liquid epoxy will also fill out the space between the spread out rods 7 and the wedging action and the fixation within the conical apertures 8 will be further improved.

With advantage the apertures 8 in the receiving body 16 can be somewhat inclined with respect to the longitudinal axis of the tension leg 10, and this inclined position must then correspond with that direction the strands 5,6 have towards the receiving body 16.

Figure 6:
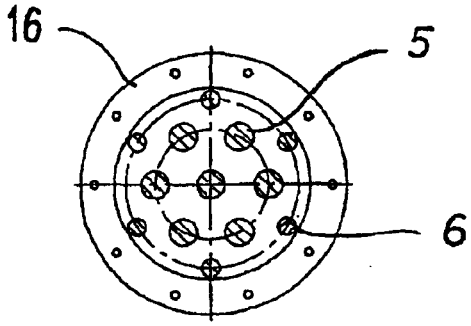
FIG. 6 shows a cross sectional view along the line B—B in FIG. 4.
Figure 7:
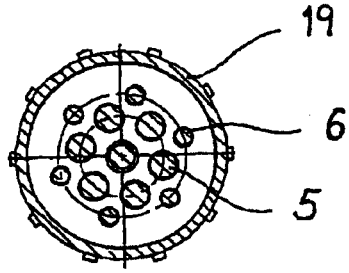
FIG. 7 shows a cross sectional view along the line in 7—7 in FIG. 4.

FIG. 6 shows a cross section through the end termination 15 at the area where the strands 5,6 enter into the receiving body 16. FIG. 7 shows a cross section through the end termination 15 at the area where the strands 5,6 exit the gland 19. Together they illustrate how the strands 5,6 diverge through the end termination 15 from the very tension leg 10 and towards the receiving body 16.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An end termination for a tension leg of non-metallic material, said tension leg being constructed of a number of strands that constitute the load carrying elements of the tension leg, said strands being twisted about the longitudinal axis of the tension leg by a predetermined laying length, each of said strands being constructed of a plurality of rods of composite material having embedded strength fibres, said rods being twisted about each other, and the strands terminate in a receiving body having connecting means and a number of through-going apertures that receive and form fixing points for the respective strands, wherein the end termination comprises an embracing element that is spaced apart from the receiving body and keeps the strands together, and between the embracing element and the receiving body the strands extend in a substantially natural direction towards and into the apertures of the receiving body.

2. The end termination according to claim 1, wherein a gathering element is arranged between the embracing element and the receiving body.

3. The end termination according to claim 1 or 2, wherein the embedded strength fibres are fibres of carbon, kevlar or aramid.

4. The end termination according to claim 1, wherein the apertures in the receiving body are somewhat inclined to the longitudinal axis of the tension leg and the inclination corresponds with the natural direction of the strands.

5. The end termination according to claim 1, wherein the apertures in the receiving body are tapered in the direction towards the embracing element.

6. The end termination according to claim 1, wherein the end termination comprises an external rigid sleeve fixed at one end thereof to the receiving body, and at the other end thereof to the embracing element and at a place intermediate the ends to the gathering element and thus maintains the stable mutual position of the parts.

7. The end termination according to claim 1, wherein the receiving body has at least one annular groove provided on an outer surface thereof for engagement with at least one first annular rib on a connecting part connected to an anchor point.

8. A coupling for use between an end termination and an anchor point according to claim 7, wherein the anchor point has at least one external annular groove for engagement with at least one second annular rib provided on the connecting part at a distance from the at least one first rib, said connecting part being radially secured by a surrounding connecting part.

9. The coupling for use between an end termination and an anchor point according to claim 8, wherein the radially outer surface of the connecting part has an upwardly directed conical form and the radially inner surface of the surrounding connecting part has a complementary conical form.

10. The coupling according to any of the claims 7–9, wherein the connecting part includes pin bolts for temporarily securing the connecting part to the anchor point.

11. A tension leg, comprising:

a plurality of strands of composite material that constitute the load carrying elements of the tension leg, said strands being twisted about the longitudinal axis of the tension leg by a predetermined laying length, each of said strands being constructed of a plurality of rods of composite material having strength fibres embedded therein, said rods being twisted about each other;

a receiving body, said strands terminating In said receiving body, said receiving body including a connector and a plurality of through-going apertures that receive and form fixing points for the respective strands; and an end termination, said end termination including an embracing element that is spaced apart from the receiving body and keeps the strands together, wherein between the embracing element and the receiving body the strands extends in a substantially natural direction towards and into the apertures of the receiving body.

12. The end termination according to claim 11, wherein a gathering element is arranged between the embracing element and the receiving body.

13. The end termination according to claim 11, wherein the embedded strength fibres are fibres of carbon, kevlar or aramid.

14. The end termination according to claim 11, wherein the apertures in the receiving body are somewhat inclined to the longitudinal axis of the tension leg and the inclination corresponds with the natural direction of the strands.

15. The end termination according to claim 11, wherein the apertures in the receiving body are tapered in the direction towards the embracing element.

16. The end termination according to claim 11, wherein the end termination comprises an external rigid sleeve fixed at one end thereof to the receiving body, and at the other end thereof to the embracing element and at a place intermediate the ends to the gathering element and thus maintains the stable mutual position of the parts.

17. The end termination according to claim 11, wherein the connector of the receiving body is formed by at least one annular groove provided on an outer surface of the receiving body for engagement with at least one first annular rib on a connecting part connected to an anchor point.

* * * * *